US012078022B2

(12) United States Patent
Books

(10) Patent No.: US 12,078,022 B2
(45) Date of Patent: Sep. 3, 2024

(54) TUBING HANGER ORIENTATION ASSEMBLY

(71) Applicant: ONESUBSEA IP UK LIMITED, London (GB)

(72) Inventor: Jacob Books, Houston, TX (US)

(73) Assignee: ONESUBSEA IP UK LIMITED, London (GB)

( * ) Notice: Subject to any disclaimer, the term of this patent is extended or adjusted under 35 U.S.C. 154(b) by 0 days.

(21) Appl. No.: 17/904,845

(22) PCT Filed: Feb. 26, 2021

(86) PCT No.: PCT/US2021/019799
§ 371 (c)(1),
(2) Date: Aug. 23, 2022

(87) PCT Pub. No.: WO2021/173918
PCT Pub. Date: Sep. 2, 2021

(65) Prior Publication Data

US 2023/0112502 A1 Apr. 13, 2023

Related U.S. Application Data

(60) Provisional application No. 62/982,283, filed on Feb. 27, 2020.

(51) Int. Cl.
*E21B 33/04* (2006.01)

(52) U.S. Cl.
CPC ..... *E21B 33/04* (2013.01)

(58) Field of Classification Search
CPC ..... E21B 33/04
See application file for complete search history.

(56) References Cited

U.S. PATENT DOCUMENTS 4,278,278 A * 7/1981 Chambless ..... E21B 33/04 29/442
4,690,214 A 9/1987 Wittrisch
(Continued)

FOREIGN PATENT DOCUMENTS

WO 2015135978 A1 9/2015

OTHER PUBLICATIONS

Search Report and Written Opinion of International Patent Application No. PCT/US2021/019799 dated Jun. 7, 2021; 10 pages.
(Continued)

*Primary Examiner* — Matthew R Buck
(74) *Attorney, Agent, or Firm* — Eileen Pape

(57) ABSTRACT

A tubing hanger orientation assembly includes an annular structure having a first set of engagement surfaces configured to guide an engagement feature from a first end portion of the annular structure to a second end portion of the annular structure in response to longitudinal movement of the annular structure in a first direction. A circumferential extent of the second end portion is less than a circumferential extent of the first end portion. The annular structure includes a second set of engagement surfaces configured to guide the engagement feature from the second end portion of the annular structure to a third end portion of the annular structure in response to longitudinal movement of the annular structure in a second direction. The third end portion extends between a first side of the first end portion and a second side of the first end portion along a circumferential axis of the annular structure.

18 Claims, 5 Drawing Sheets

(56) References Cited

U.S. PATENT DOCUMENTS

| | | | | |
|---|---|---|---|---|
| 5,145,006 | A | 9/1992 | June | |
| 7,032,673 | B2 | 4/2006 | Dezen et al. | |
| 8,151,892 | B2 | 4/2012 | Williams et al. | |
| 9,273,531 | B2 | 3/2016 | Tan et al. | |
| 10,830,015 | B2 | 11/2020 | DeBerry et al. | |
| 11,834,918 | B2 | 12/2023 | McLaughlin et al. | |
| 2009/0071658 | A1* | 3/2009 | Reid | E21B 43/12 166/330 |
| 2015/0259990 | A1* | 9/2015 | June | E21B 19/002 166/341 |
| 2016/0076329 | A1 | 3/2016 | Nguyen et al. | |

OTHER PUBLICATIONS

International Preliminary Report on Patentability of International Patent Application No. PCT/US2021/01979 dated Sep. 9, 2022, 7 pages.

Exam Report issued in United Kingdom Patent Application No. GB2212366.5 dated Aug. 30, 2023, 2 pages.

* cited by examiner

TUBING HANGER ORIENTATION ASSEMBLY

CROSS REFERENCE TO RELATED APPLICATION

This application claims priority from and the benefit of U.S. Provisional Application Ser. No. 62/982,283 entitled "Multi-Level camming helix in tubing hanger running tool", filed Feb. 27, 2020, which is hereby incorporated by reference in its entirety.

BACKGROUND

The present disclosure relates generally to a tubing hanger orientation assembly.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Fluids (e.g., hydrocarbons) may be extracted from subsurface reservoirs and transported to the surface for commercial sales, such as for use in the power industry, transportation industry, manufacturing industry, and other applicable industries. For example, a well may be drilled into the ground to a subsurface reservoir, and equipment may be installed in the well and on the surface to facilitate extraction of the fluids. In some cases, the wells may be offshore (e.g., subsea), and the equipment may be disposed underwater, on offshore platforms, and/or on floating systems.

In some drilling and production systems, a hanger, such as a tubing hanger, may be used to suspend a string (e.g., piping for a flow in and/or out of the well). Such a hanger may be disposed within a wellhead, which supports both the hanger and the string. For example, a tubing hanger may be lowered into a wellhead of a wellhead system by a drilling string. During the running or lowering process, the tubing hanger may be coupled to the drilling string by a tubing hanger running tool (THRT). Once the tubing hanger has been lowered into a landed position within the wellhead, the tubing hanger may be permanently locked into position. The THRT may then be uncoupled from the tubing hanger and extracted from the wellhead system by the drilling string.

To facilitate alignment of various flow passages of the tubing hanger with corresponding flow passages of a production tree (e.g., which may be coupled to the wellhead after the THRT is extracted from the wellhead system), the wellhead system may include an orientation spool positioned above the wellhead. During the tubing hanger landing process, the tubing hanger may be rotated to approximately the target orientation (e.g., within 90 degrees of the target orientation). The tubing hanger may then be temporarily landed within the wellhead, and an extendable element of the orientation spool may be extended to engage a clearance within the THRT. Next, the THRT/tubing hanger may be raised. Contact between the extendable element and a camming surface of the THRT may drive the tubing hanger to a target orientation as the THRT/tubing hanger is raised. When the tubing hanger reaches the target orientation, the extendable element engages a slot in the THRT. As the tubing hanger is subsequently lowered to the final landed position, engagement of the extendable element with the slot maintains the tubing hanger in the target orientation, thereby locating each flow passage of the tubing hanger in a target circumferential position within the wellhead. As previously discussed, once the tubing hanger is landed, the THRT may be uncoupled from the tubing hanger and extracted from the wellhead system.

To establish a wellhead system having a desired height, the length of the orientation spool and the corresponding length of the THRT may be limited. Accordingly, the camming surface may only extend about a portion of the circumferential extent of the THRT. As a result, as described above, the tubing hanger may be rotated to approximately the target orientation before the tubing hanger is initially landed within the wellhead. Increasing the length of the camming surface to facilitate a larger angular offset between the initial orientation of the tubing hanger and the target orientation may undesirably increase the length of the THRT/orientation spool, thereby establishing an undesirable bending load on component(s) of the wellhead system.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In certain embodiments, a tubing hanger orientation assembly includes an annular structure having multiple engagement surfaces. The engagement surfaces include a first set of engagement surfaces configured to guide an engagement feature from a first end portion of the annular structure to a second end portion of the annular structure in response to longitudinal movement of the annular structure relative to the engagement feature in a first direction. The first end portion extends about a substantial portion of a circumferential extent of the annular structure, and a circumferential extent of the second end portion is less than a circumferential extent of the first end portion. The engagement surfaces also include a second set of engagement surfaces configured to guide the engagement feature from the second end portion of the annular structure to a third end portion of the annular structure in response to longitudinal movement of the annular structure relative to the engagement feature in a second direction, opposite the first direction. The third end portion extends between a first side of the first end portion and a second side of the first end portion along a circumferential axis of the annular structure, and a circumferential extent of the third end portion is substantially equal to a circumferential extent of the engagement feature. In addition, each engagement surface is configured to drive the annular structure to rotate relative to the engagement feature in response to contact with the engagement feature and longitudinal movement of the annular structure relative to the engagement feature.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
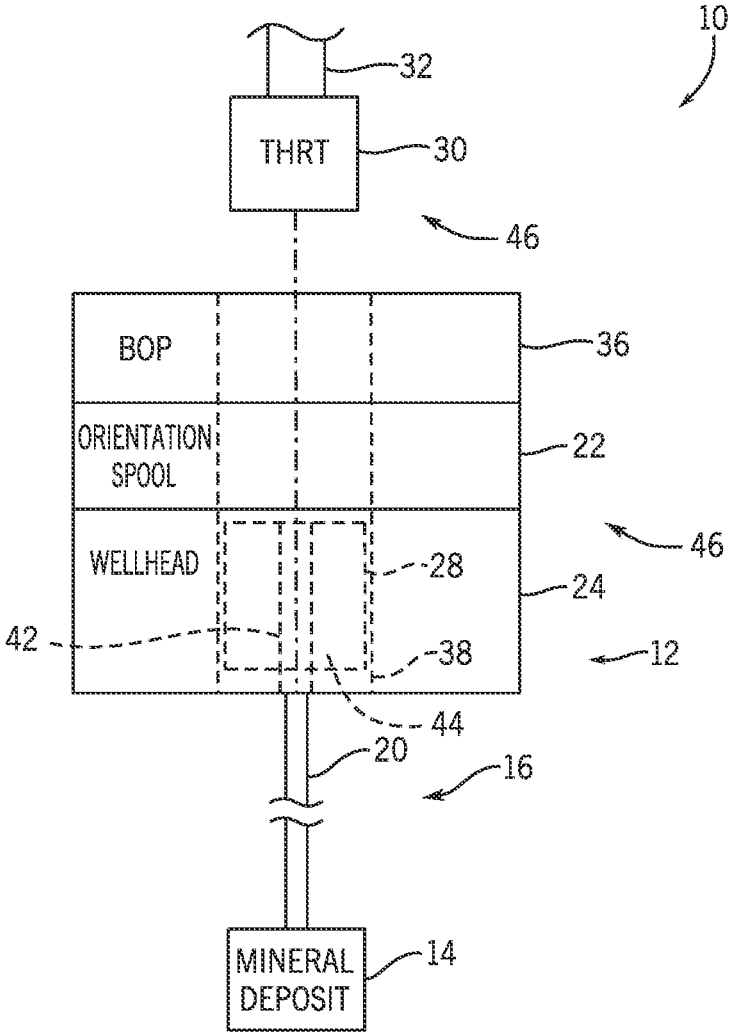
FIG. 1 is a block diagram of an embodiment of a resource extraction system.

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

As explained above, to establish a wellhead system having a desired height, the length of the orientation spool and the corresponding length of the tubing hanger running tool (THRT) may be limited. Accordingly, the camming surface of the THRT may only extend about a portion of the circumferential extent of the THRT. As a result, the tubing hanger may be rotated to approximately the target orientation before the tubing hanger is initially landed within the wellhead. Increasing the length of the camming surface to facilitate a larger angular offset between the initial orientation of the tubing hanger and the target orientation may undesirably increase the length of the THRT/orientation spool, thereby establishing an undesirable bending load on component(s) of the wellhead system.

In certain embodiments disclosed herein, a tubing hanger orientation assembly may be utilized that enables the THRT/tubing hanger to be oriented at any orientation during the initial landing, that drives the tubing hanger to rotate to the target orientation during the landing process, and that establishes a desired length of the THRT/orientation spool. In certain embodiments, the tubing hanger orientation assembly includes an annular structure (e.g., THRT) having multiple engagement surfaces. The engagement surfaces include a first set of engagement surfaces configured to guide an engagement feature from a first end portion of the annular structure to a second end portion of the annular structure in response to longitudinal movement of the annular structure relative to the engagement feature in a first direction (e.g., upward direction). The first end portion extends about a substantial portion of a circumferential extent of the annular structure, and a circumferential extent of the second end portion is less than a circumferential extent of the first end portion. The engagement surfaces also include a second set of engagement surfaces configured to guide the engagement feature from the second end portion of the annular structure to the first end portion of the annular structure in response to longitudinal movement of the annular structure relative to the engagement feature in a second direction (e.g., downward direction), opposite the first direction. The third end portion extends between a first side of the first end portion and a second side of the first end portion along a circumferential axis of the annular structure, and a circumferential extent of the third end portion is substantially equal to a circumferential extent of the engagement feature. Furthermore, each engagement surface is configured to drive the annular structure to rotate relative to the engagement feature in response to contact with the engagement feature and longitudinal movement of the annular structure relative to the engagement feature.

For example, in certain embodiments, the annular structure includes/is the THRT, and the engagement feature is coupled to the orientation spool. In such embodiments, the engagement feature may be retracted during the initial landing of the tubing hanger, which is non-rotatably coupled to the THRT, within the wellhead. Once the tubing hanger is initially landed, the engagement feature may be extended, such that the engagement feature is positioned within the first end portion of the THRT. The THRT/tubing hanger may then be moved longitudinally upward. Upward movement of the THRT/tubing hanger may cause an engagement surface of the first set of engagement surfaces to engage the engagement feature and to guide the engagement feature to the second end portion. As the engagement surface of the first set of engagement surfaces guides the engagement feature to the second end portion, contact between the engagement surface and the engagement feature drives the THRT/tubing hanger to rotate to an intermediate orientation. The THRT/tubing hanger may then be moved longitudinally downward to the final landed position. Downward movement of the THRT/tubing hanger may cause an engagement surface of the second set of engagement surfaces to engage the engagement feature and to guide the engagement feature to the third end portion. As the engagement surface of the second set of engagement surfaces guides the engagement feature to the third end portion, contact between the engagement surface and the engagement feature drives the THRT/tubing hanger to rotate to a target orientation. While the tubing hanger is in the target orientation, various flow passages of the tubing hanger are located at target circumferential positions within the wellhead (e.g., thereby facilitating connection with corresponding flow passages of a production tree that may be coupled to the wellhead after the THRT and the orientation spool are extracted from the wellhead system). Because the first and third end portions collectively extend about the entire circumferential extent of the THRT, the THRT/tubing hanger may be initially landed in any orientation, and the tubing hanger orientation assembly may guide the THRT/tubing hanger from the initially landed orientation to the target orientation. In addition, because the first set of engagement surfaces is configured to drive the THRT/tubing hanger to rotate to the intermediate orientation in response to the upward movement, and the second set of engagement surfaces is configured to drive the THRT/tubing hanger to rotate to the target orientation in response to the downward movement, the length of the THRT and the corresponding length of the orientation spool may be reduced (e.g., as compared to a THRT having a single set of engagement surfaces/single engagement surface configured to drive the THRT/tubing hanger to rotate from an initial orientation to the target orientation via movement of the THRT/tubing hanger in a single direction). As a result, the bending load applied to component(s) of the wellhead system may be reduced, and/or the cost of the wellhead system may be reduced.

FIG. 1 is a block diagram of an embodiment of a resource extraction system 10. The resource extraction system 10 may be configured to extract various minerals and natural resources, including hydrocarbons (e.g., oil and/or natural gas) from the earth, or the resource extraction system may be configured to inject substances into the earth. In some embodiments, the resource extraction system 10 is land-based (e.g., a surface system) or subsea (e.g., a subsea system). As illustrated, the resource extraction system 10 includes a wellhead system 12 coupled to a mineral deposit 14 via a well 16 having a well-bore 20.

In the illustrated embodiment, the wellhead system 12 includes an orientation spool 22, a wellhead 24, and a tubing hanger 28. The resource extraction system 10 may include other device(s) that are coupled to the wellhead system 12 and/or device(s) that are used to assemble various components of the wellhead system 12. For example, in the illustrated embodiment, the resource extraction system 10 includes a tubing hanger running tool (THRT) 30 suspended from a drilling string 32. In certain embodiments, the tubing hanger 28 supports tubing (e.g., a tubing string). During a running or lowering process, the THRT 30 is non-rotatably coupled to the tubing hanger 28, thereby coupling the tubing hanger 28 to the drilling string 32. The THRT 30, which is coupled to the tubing hanger 28, is lowered (e.g., run) from an offshore vessel to the wellhead system 12. Once the tubing hanger 28 has been lowered into a landed position within the wellhead 24, the tubing hanger 28 may be permanently locked into position. The THRT 30 may then be uncoupled from the tubing hanger 28 and extracted from the wellhead system 12 by the drilling string 32, as illustrated.

In the illustrated embodiment, the wellhead system 12 includes a blowout preventer (BOP) 36. The BOP 36 may include a variety of valves, fittings, and controls to block oil, gas, or other fluid from exiting the well in the event of an unintentional release of pressure or an overpressure condition. Furthermore, the wellhead 24 has a bore 38, which may provide access to the well-bore 20 for various completion and workover procedures. For example, components may be run down to the wellhead system 12 and disposed in the wellhead bore 38 to seal-off the well-bore 20, to inject chemicals down-hole, to suspend tools down-hole, to retrieve tools, and the like.

The well-bore 20 may contain elevated fluid pressures. For example, pressures within the well-bore 20 may exceed 10,000 pounds per square inch (PSI), 15,000 PSI, or 20,000 PSI. Accordingly, the resource extraction system 10 may employ various mechanisms, such as mandrels, seals, plugs, and valves, to control the well 16. For example, the illustrated tubing hanger 28 may be disposed within the wellhead 24 to secure tubing suspended in the well-bore 20, and to provide a path for hydraulic control fluid, chemical injection, electrical connection(s), fiber optic connection(s), and the like. The tubing hanger 28 includes a central bore 42 that extends through the center of a body 44 of the tubing hanger 28, and that is in fluid communication with the well-bore 20. The central bore 42 is configured to facilitate flow of hydrocarbons through the body 44 of the tubing hanger 28.

In the illustrated embodiment, the resource extraction system 10 includes a tubing hanger orientation assembly 46 configured to rotate the tubing hanger 28 to a target orientation within the wellhead 24, thereby locating various flow passages of the tubing hanger 28 at target circumferential positions within the wellhead 24 (e.g., to facilitate connection with corresponding flow passages of a production tree that may be coupled to the wellhead after the THRT and the orientation spool 22 are extracted from the wellhead system). The tubing hanger orientation assembly 46 includes the THRT 30 and the orientation spool 22. In certain embodiments, the tubing hanger orientation assembly 46 includes an engagement feature extending radially inward from the orientation spool 22, and the THRT 30 includes multiple engagement surfaces formed on an outer surface of the THRT. As discussed in detail below, the engagement surfaces include a first set of engagement surfaces configured to guide the engagement feature from a first end portion of the THRT to a second end portion of the THRT in response to longitudinal movement of the THRT relative to the engagement feature in a first direction (e.g., upward direction). The first end portion extends about a substantial portion of a circumferential extent of the THRT, and a circumferential extent of the second end portion is less than a circumferential extent of the first end portion. The engagement surfaces also include a second set of engagement surfaces configured to guide the engagement feature from the second end portion of the THRT to the first end portion of the THRT in response to longitudinal movement of the THRT relative to the engagement feature in a second direction (e.g., downward direction), opposite the first direction. The third end portion extends between a first side of the first end portion and a second side of the first end portion along a circumferential axis of the THRT, and a circumferential extent of the third end portion is substantially equal to a circumferential extent of the engagement feature. Furthermore, each engagement surface is configured to drive the THRT to rotate relative to the engagement feature in response to contact with the engagement feature and longitudinal movement of the THRT relative to the engagement feature. As discussed in detail below, the THRT 30/tubing hanger 28 may be lifted and lowered during the landing process, thereby driving the tubing hanger to the target orientation.

Figure 2:
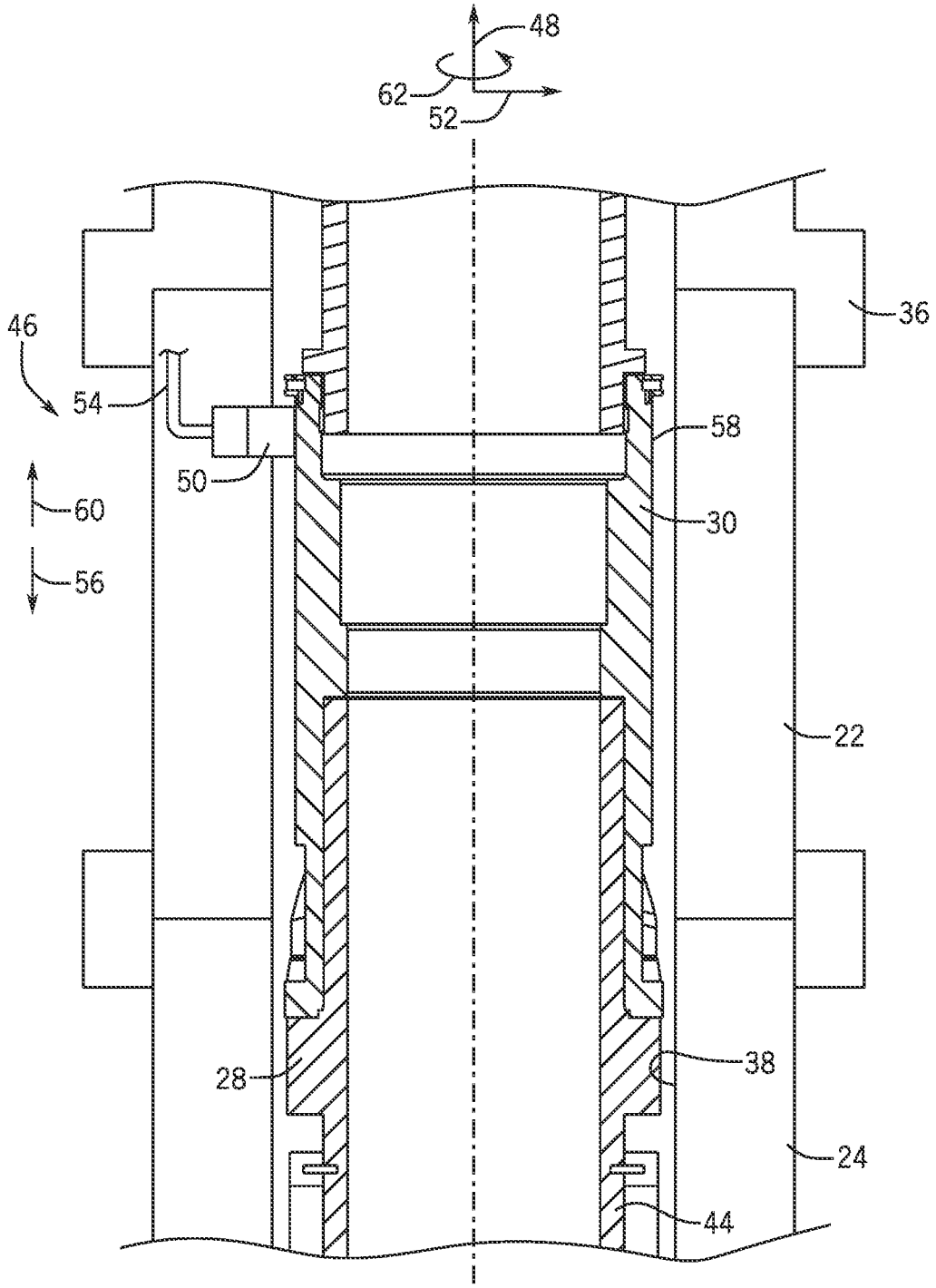
FIG. 2 is a cross-sectional view of an embodiment of a tubing hanger orientation assembly that may be employed within the resource extraction system of FIG. 1.

FIG. 2 is a cross-sectional view of an embodiment of a tubing hanger orientation assembly 46 that may be employed within the resource extraction system of FIG. 1. As illustrated, the orientation spool 22 is positioned between the BOP 36 and the wellhead 24 along a longitudinal axis 48. In certain embodiments, the orientation spool may be removed after the landing process is complete (e.g., and a production tree may be coupled to the wellhead). In the illustrated embodiment, the tubing hanger orientation assembly 46 includes an engagement feature 50 extending radially inward from the orientation spool 22 (e.g., inward along a radial axis 52) and coupled to the orientation spool 22. In addition, the engagement feature 50 is movable along the radial axis 52. In the certain embodiments, the engagement feature 50 is biased radially outward by biasing member(s) and configured to be driven radially inward (e.g., toward the THRT 30) via hydraulic fluid provided by a hydraulic fluid conduit 54. Accordingly, while the force applied to the engagement feature 50 by the hydraulic fluid is less than the force applied by the biasing member(s), the engagement feature retracts, and while the force applied to the engagement feature 50 by the hydraulic fluid is greater than the force applied by the biasing member(s), the engagement feature extends (e.g., into engagement with the THRT 30).

While the engagement feature is configured to be driven radially inward by hydraulic fluid in the illustrated embodiment, in other embodiments, the engagement feature may be driven radially inward by other suitable actuator(s)/actuation assembly/assemblies (e.g., alone or in combination with the hydraulic actuation), such as electromechanical actuator(s), pneumatic actuator(s), other suitable actuator(s), or a combination thereof. Furthermore, while biasing the engagement feature radially outward is disclosed above, in certain embodiments, the engagement feature may be driven to move radially outward by actuator(s)/actuation assembly/assemblies (e.g., alone or in combination with the biasing member(s)), such as electromechanical actuator(s), pneumatic actuator(s), hydraulic actuator(s), other suitable actuator(s), or a combination thereof. For example, the biasing member(s) configured to urge the engagement feature to move radially outward may be omitted. In addition, in certain embodiments, the engagement feature may be biased radially outward by biasing member(s). Furthermore, in certain embodiments, the tubing hanger orientation assembly may include a lockout device (e.g., pin, cam, etc.) configured to block extension of the engagement feature while the lockout device is enabled and to enable extension of the engagement feature while the lockout device is disabled. In addition, the engagement feature may have any shape suitable for engagement with engagement surfaces of the THRT 30. For example, the engagement feature may have a circular cross-section, an elliptical cross-section, or a polygonal cross-section, among other suitable cross-sectional shapes.

During the initial landing of the tubing hanger 28 within the wellhead 24 (e.g., during movement of the THRT/tubing hanger in a downward direction 56 along the longitudinal axis 48), the engagement feature 50 may be retracted, thereby facilitating passage of the THRT 30 through the orientation spool 22 without engagement of the engagement feature 50 with the engagement surfaces of the THRT 30. Once the tubing hanger 28 is initially landed, as illustrated, the engagement feature 50 may be extended, such that the engagement feature is positioned within a first end portion 58 of the THRT 30. The THRT/tubing hanger may then be moved in an upward direction 60 along the longitudinal axis 48. Upward movement of the THRT/tubing hanger may cause an engagement surface of a first set of engagement surfaces of the THRT 30 to engage the engagement feature 50 and to guide the engagement feature 50 to a second end portion of the THRT 30. As the engagement surface of the first set of engagement surfaces guides the engagement feature 50 to the second end portion, contact between the engagement surface and the engagement feature 50 drives the THRT/tubing hanger to rotate along a circumferential axis 62 to an intermediate orientation. The THRT/tubing hanger may then be moved in the downward direction 56 to a final landed position. Downward movement of the THRT/tubing hanger may cause an engagement surface of a second set of engagement surfaces of the THRT 30 to engage the engagement feature 50 and to guide the engagement feature 50 to a third end portion of the THRT 30. As the engagement surface of the second set of engagement surfaces guides the engagement feature 50 to the third end portion, contact between the engagement surface and the engagement feature 50 drives the THRT/tubing hanger to rotate to a target orientation. While the tubing hanger 28 is in the target orientation, various flow passages of the tubing hanger are located at target circumferential positions within the wellhead (e.g., thereby facilitating connection with corresponding flow passages of a production tree that may be coupled to the wellhead after the THRT and the orientation spool are extracted from the wellhead system).

Because the first and third end portions collectively extend about the entire circumferential extent of the THRT, the THRT/tubing hanger may be initially landed in any orientation, and the tubing hanger orientation assembly 46 may drive the THRT/tubing hanger to rotate from the initially landed orientation to the target orientation. In addition, because the first set of engagement surfaces is configured to drive the THRT/tubing hanger to rotate to the intermediate orientation in response to the upward movement, and the second set of engagement surfaces is configured to drive the THRT/tubing hanger to rotate to the target orientation in response to the downward movement, the length of the THRT 30 and the corresponding length of the orientation spool 22 may be reduced (e.g., as compared to a THRT having a single set of engagement surfaces/single engagement surface configured to drive the THRT/tubing hanger to rotate from an initial orientation to the target orientation via movement of the THRT/tubing hanger in a single direction). As a result, the bending load applied to component(s) of the wellhead system may be reduced, and/or the cost of the wellhead system may be reduced.

Figure 3:
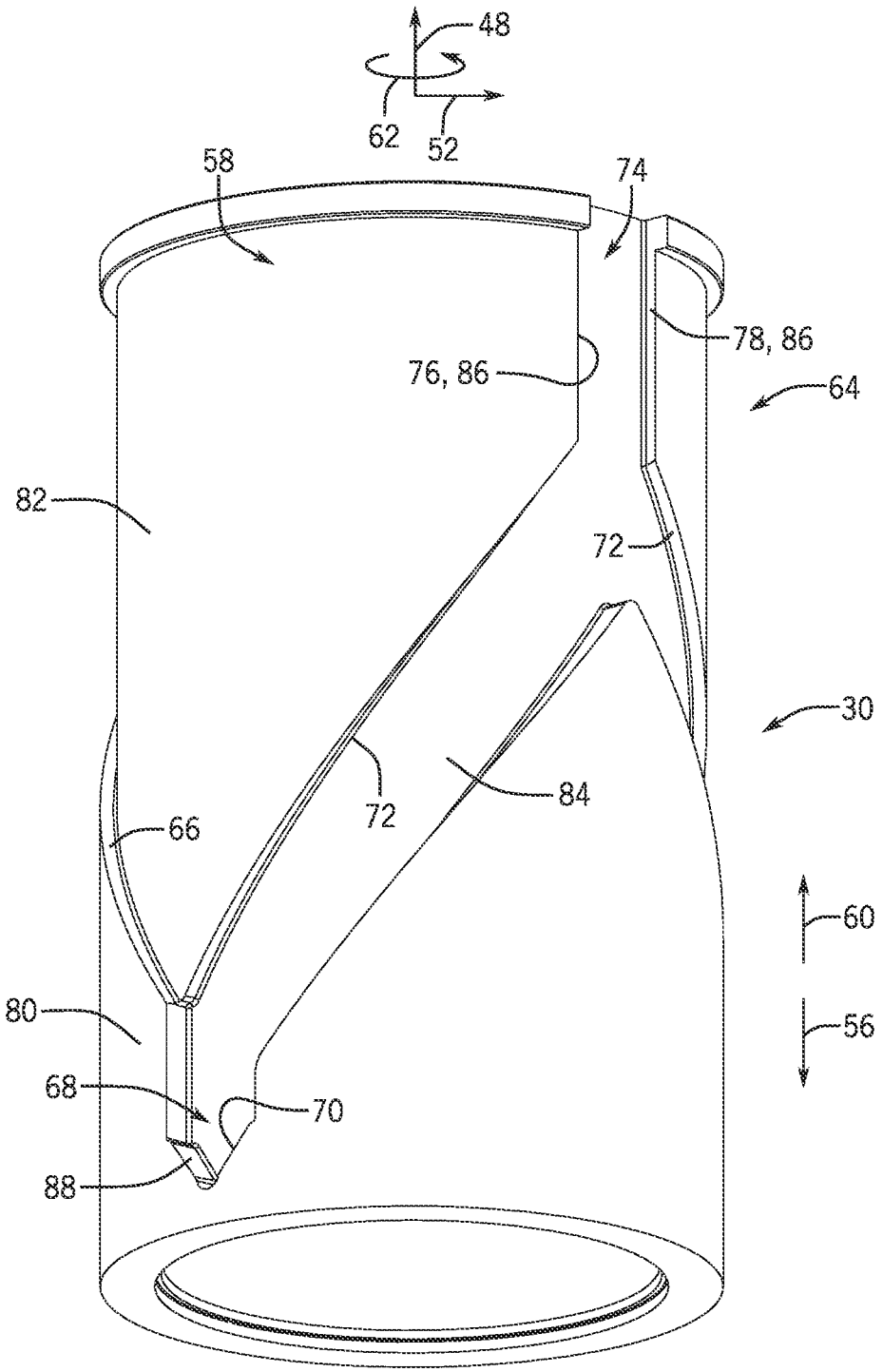
FIG. 3 is a perspective view of an embodiment of a tubing hanger running tool (THRT) that may be employed within the tubing hanger orientation assembly of FIG. 2.

FIG. 3 is a perspective view of an embodiment of a THRT 30 that may be employed within the tubing hanger orientation assembly of FIG. 2. In the illustrated embodiment, the THRT 30 includes multiple engagement surfaces formed on an outer surface 64 of the THRT 30. As discussed in detail below, the engagement surfaces include a first set of engagement surfaces 66 configured to guide the engagement feature from the first end portion 58 of the THRT 30 to the second end portion 68 of the THRT 30 in response to longitudinal movement of the THRT 30 relative to the engagement feature in a first direction (e.g., the upward direction 60). The first end portion 58 extends about a substantial portion of a circumferential extent of the THRT 30 (e.g., extent of the THRT 30 along the circumferential axis 62), and a circumferential extent of the second end portion 68 (e.g., extent of the second end portion 68 along the circumferential axis 62) is less than a circumferential extent of the first end portion 58 (e.g., extent of the first end portion 58 along the circumferential axis 62). In the illustrated embodiment, the second end portion 68 includes multiple recesses 70, and each engagement surface of the first set of engagement surfaces 66 is configured to guide the engagement feature to a respective recess 70 in response to the longitudinal movement of the THRT 30 relative to the engagement feature in the first direction (e.g., the upward direction 60). However, as discussed in detail below, the second end portion may have other suitable configurations.

In addition, the engagement surfaces include a second set of engagement surfaces 72 configured to guide the engagement feature from the second end portion 68 of the THRT 30 to the third end portion 74 of the THRT 30 in response to longitudinal movement of the THRT 30 relative to the engagement feature in a second direction (e.g., downward direction 56), opposite the first direction. As illustrated, the third end portion 74 extends between a first side 76 of the first end portion 58 and a second side 78 of the first end portion 58 along the circumferential axis 62. In addition, a circumferential extent of the third end portion 74 (e.g., extent of the third end portion 74 along the circumferential axis 62) is substantially equal to a circumferential extent of the engagement feature. For example, the circumferential extent of the third end portion may be about 5 percent, about 4 percent, about 3 percent, about 2 percent, about 1 percent, about 0.5 percent, about 0.25 percent, about 0.1 percent, or about 0.05 percent larger than the circumferential extent of the engagement feature. Each engagement surface of the THRT 30 is configured to drive the THRT 30 to rotate relative to the engagement feature in response to contact with the engagement feature and longitudinal movement of the THRT 30 relative to the engagement feature. In addition, while the engagement feature is positioned within the third end portion 74 of the THRT 30, the tubing hanger is oriented at the target orientation. Due to the configuration of the engagement surfaces, the THRT is rotated such that the engagement feature is positioned within the third end portion 74 in response to the upward and downward movements of the THRT regardless of the initial orientation of the THRT/initial circumferential position of the engagement feature relative to the THRT.

In the illustrated embodiment, each engagement surface of the first set of engagement surfaces 66 extends radially inward (e.g., inward along the radial axis 52) from a first circumferential surface 80 to a second circumferential surface 82. In addition, each engagement surface of the second set of engagement surfaces 72 extends radially inward (e.g., inward along the radial axis 52) from the second circumferential surface 82 to a third circumferential surface 84. Furthermore, engagement surfaces 86 that form the third end portion 74 extend radially inward (e.g., inward along the radial axis 52) from the second circumferential surface 82 to the third circumferential surface 84. Engagement surfaces 88 that form the second end portion extend radially inward (e.g., inward along the radial axis 52) from the first circumferential surface 80 to the third circumferential surface 84. Each engagement surface may have any suitable radial extent. For example, the engagement surfaces extending between the first and second circumferential surfaces may have a radial extent of about 0.5 cm to about 5 cm, about 1 cm to about 4 cm, about 1 cm to about 2 cm, or about 1.27 cm. Additionally or alternatively, the engagement surfaces extending between the second and third circumferential surfaces may have a radial extent of about 0.5 cm to about 5 cm, about 1 cm to about 4 cm, about 1 cm to about 2 cm, or about 1.27 cm. Additionally or alternatively, the engagement surfaces extending between the first and third circumferential surfaces may have a radial extent of about 1 cm to about 10 cm, about 2 cm to about 8 cm, about 2 cm to about 4 cm, or about 2.54 cm. Because the engagement feature is driven/urged radially inward, the engagement feature may substantially maintain contact with the respective first, second, or third circumferential surface during the upward and downward movement of the THRT/tubing hanger. While the THRT 30 includes three surfaces that establish three radial extents in the illustrated embodiment, in other embodiments, the THRT may have more or fewer surfaces (e.g., 2, 4, 5, 6, or more) to establish more or fewer different engagement surface radial extents.

Figure 4:
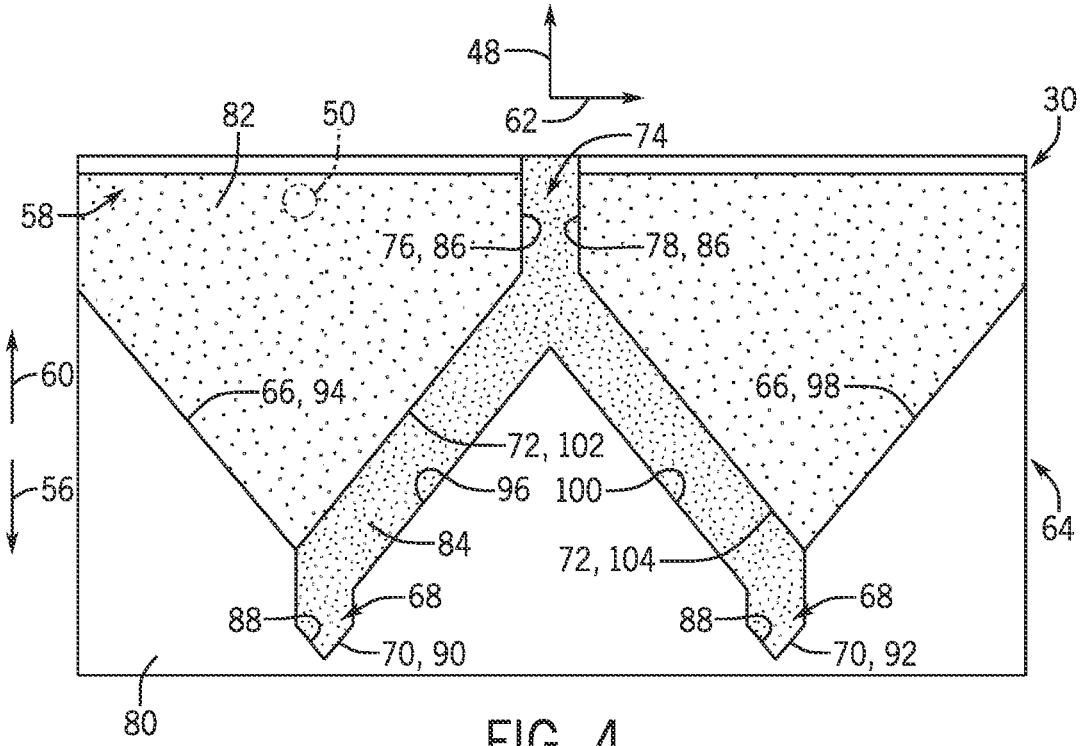
FIG. 4 is a two-dimensional projection of an outer surface of the tubing hanger of FIG. 3.

FIG. 4 is a two-dimensional projection of the outer surface 64 of the THRT 30 of FIG. 3, in which the second circumferential surface 82 and the third circumferential surface 84 are represented by different background patterns. As previously discussed, the engagement surfaces include a first set of engagement surfaces 66 configured to guide the engagement feature 50 from the first end portion 58 of the THRT 30 to the second end portion 68 of the THRT 30 in response to longitudinal movement of the THRT 30 relative to the engagement feature in a first direction (e.g., the upward direction 60). In addition, the engagement surfaces include a second set of engagement surfaces 72 configured to guide the engagement feature from the second end portion 68 of the THRT 30 to the third end portion 74 of the THRT 30 in response to longitudinal movement of the THRT 30 relative to the engagement feature in a second direction (e.g., downward direction 56), opposite the first direction. Furthermore, each engagement surface of the first set of engagement surfaces 66 extends radially inward from the first circumferential surface 80 to the second circumferential surface 82, each engagement surface of the second set of engagement surfaces 72 extends radially inward from the second circumferential surface 82 to the third circumferential surface 84, the engagement surfaces 86 that form the third end portion 74 extend radially inward from the second circumferential surface 82 to the third circumferential surface 84, and the engagement surfaces 88 that form the second end portion 68 extend radially inward from the first circumferential surface 80 to the third circumferential surface 84.

In the illustrated embodiment, the recesses 70 of the second end portion 68 include a first recess 90 and a second recess 92. Furthermore, in the illustrated embodiment, the engagement surfaces include a first engagement surface 94, which is part of the first set of engagement surfaces 66, configured to guide the engagement feature 50 from the first end portion 58 to the first recess 90 in response to longitudinal movement of the THRT 30 relative to the engagement feature 50 in the first direction (e.g., upward direction 60). In addition, the engagement surfaces include a second engagement surface 96 configured to guide the engagement feature 50 from the first end portion 58 or the third end portion 74 (e.g., if the engagement feature 50 is positioned within the third end portion 74 after the initial landing of the tubing hanger) to the first recess 90 in response to longitudinal movement of the THRT 30 relative to the engagement feature 50 in the first direction (e.g., upward direction 60). As illustrated, the first and second engagement surfaces converge toward the first recess 90. The engagement surfaces also include a third engagement surface 98, which is part of the first set of engagement surfaces 66, configured to guide the engagement feature 50 from the first end portion 58 to the second recess 92 in response to longitudinal movement of the THRT 30 relative to the engagement feature 50 in the first direction (e.g., upward direction 60). Furthermore, the engagement surfaces include a fourth engagement surface 100 configured to guide the engagement feature 50 from the first end portion 58 or the third end portion 74 (e.g., if the engagement feature 50 is positioned within the third end portion 74 after the initial landing of the tubing hanger) to the second recess 92 in response to longitudinal movement of the THRT 30 relative to the engagement feature 50 in the first direction (e.g., upward direction 60). As illustrated, the third and fourth engagement surfaces converge toward the second recess 92. Accordingly, the first, second, third, and fourth engagement surfaces are configured to guide the engagement feature to one of the recesses in response to upward movement of the THRT regardless of the initial orientation of the THRT/initial circumferential position of the engagement feature relative to the THRT.

Furthermore, the engagement surfaces include a fifth engagement surface 102, which is part of the second set of engagement surfaces 72, configured to guide the engagement feature 50 from the first recess 90 to the third end portion 74 in response to longitudinal movement of the THRT 30 relative to the engagement feature 50 in the second direction (e.g., downward direction 56). The engagement surfaces also include a sixth engagement surface 104, which is part of the second set of engagement surfaces 72, configured to guide the engagement feature 50 from the second recess 92 to the third end portion 74 in response to longitudinal movement of the THRT 30 relative to the engagement feature 50 in the second direction (e.g., downward direction 56). As illustrated, the fifth and sixth engagement surfaces converge toward the third end portion 74. Accordingly, the fifth and sixth engagement surfaces are configured to guide the engagement feature to the third end portion in response to upward movement of the THRT regardless of the intermediate orientation of the THRT/which recess receives the engagement feature. As a result, the THRT is rotated such that the engagement feature is positioned within the third end portion 74 in response to the upward and downward movements of the THRT regardless of the initial orientation of the THRT/initial circumferential position of the engagement feature relative to the THRT.

Furthermore, in the illustrated embodiment, the first engagement surface 94 and the third engagement surface 98 have a first radial extent (e.g., from the first circumferential surface 80 to the second circumferential surface 82), the second engagement surface 96 and the fourth engagement surface 100 have a second radial extent (e.g., from the first circumferential surface 80 to the third circumferential surface 84), and the second radial extent is greater than the first radial extent. However, in other embodiments, the second radial extent may be less than or equal to the first radial extent, and/or in certain embodiments, the first and third engagement surfaces may have different radial extents, and/or the second and fourth engagement surfaces may have different radial extents. In addition, in the illustrated embodiment, a third radial extent (e.g., from the first circumferential surface 80 to the third circumferential surface 84) of the engagement surfaces 88 forming the first and second recesses is substantially equal to the second radial extent of the second and fourth engagement surfaces. However, in other embodiments, the third radial extent may be greater than or less than the second radial extent, and/or in certain embodiments, at least two engagement surfaces forming the first and second recesses may have different radial extents. Furthermore, in the illustrated embodiment, the fifth engagement surface 102 and the sixth engagement surface 104 have a fourth radial extent (e.g., from the second circumferential surface 82 to the third circumferential surface 84), and the fourth radial extent is substantially equal to the second radial extent minus the first radial extent. However, in other embodiments, the fourth radial extent may be greater than or less than the second radial extent minus the first radial extent, and/or in certain embodiments, the fifth and sixth engagement surfaces may have different radial extents. In the illustrated embodiment, a fifth radial extent (e.g., from the second circumferential surface 82 to the third circumferential surface 84) of the engagement surfaces 86 forming the third end portion 74 is substantially equal to the second radial extent minus the first radial extent. However, in other embodiments, the fifth radial extent may be greater than or less than the second radial extent minus the first radial extent, and/or in certain embodiments, at least two of the engagement surfaces forming the third end portion may have different radial extents.

In the illustrated embodiment, the radial extent of each engagement surface is substantially constant. However, in other embodiments, the radial extent of at least one engagement surface may vary along the extent of the engagement surface. Furthermore, the radial extent of each of the first, second, and third circumferential surfaces is substantially constant. However, in other embodiments, the radial extent of at least one of the first circumferential surface, the second circumferential surface, or the third circumferential surface may vary (e.g., along the longitudinal axis and/or along the circumferential axis).

In the illustrated embodiment, each engagement surface is substantially straight (e.g., in the illustrated two-dimensional projection) and oriented at an angle relative to the longitudinal axis 48. For example, the first engagement surface 94 and the third engagement surface 98 may be oriented at an angle of about 10 degrees to about 80 degrees, about 20 degrees to about 70 degrees, about 30 degrees to about 60 degrees, about 30 degrees to about 50 degrees, about 35 degrees to about 40 degrees, or about 38 degrees relative to the longitudinal axis. In addition, the second engagement surface 96, the fourth engagement surface 100, the fifth engagement surface 102, and the sixth engagement surface 104 may be oriented at an angle of about 10 degrees to about 80 degrees, about 20 degrees to about 70 degrees, about 30 degrees to about 60 degrees, about 30 degrees to about 50 degrees, about 35 degrees to about 40 degrees, or about 36 degrees relative to the longitudinal axis. While the first and third engagement surfaces are oriented at substantially the same angle in the illustrated embodiment, in other embodiments, the first and third engagement surfaces may be oriented at different angles. Furthermore, while the second, fourth, fifth, and sixth engagement surfaces are oriented at the same angle in the illustrated embodiment, in other embodiments, at least two of the second engagement surface, the fourth engagement surface, the fifth engagement surface, or the sixth engagement surface may be oriented at different angles. Because each engagement surface is substantially straight in the illustrated embodiment, the engagement surfaces collectively form a substantially folded helical shape, in which the fold is positioned at the second end portion. While each engagement surface is substantially straight (e.g., in the illustrated two-dimensional projection) in the illustrated embodiment, in other embodiments, at least one of the engagement surfaces may have another suitable shape (e.g., curved, wavy, polygonal, etc.).

By way of example, during the landing process, the engagement feature 50 may be located at the illustrated position along the circumferential axis 62 after the initial landing of the THRT/tubing hanger. As previously discussed, after the initial landing, the engagement feature 50 may be extended, such that the engagement feature engages the second circumferential surface 82 or the third circumferential surfaced 84 of the THRT 30. The THRT 30 may then be moved in the upward direction 60. As the THRT 30 moves upwardly, the engagement feature 50 may move toward the first engagement surface 94, contact the first engagement surface 94, and then move along the first engagement surface 94 to the first recess 90. Contact between the engagement feature 50 and the first engagement surface 94 may drive the THRT 30 to rotate in response to the upward movement of the THRT 30, such that the THRT 30 reaches an intermediate orientation as the engagement feature 50 engages the first recess 90. The THRT 30 may then be moved in the downward direction 56. As the THRT 30 moves downwardly, the engagement feature 50 may move along the fifth engagement surface 102 to the third end portion 74. Contact between the engagement feature 50 and the fifth engagement surface 102 may drive the THRT 30 to rotate in response to the downward movement of the THRT 30, such that the THRT 30 reaches the target orientation as the engagement feature 50 engages the third end portion 74.

Figure 5:
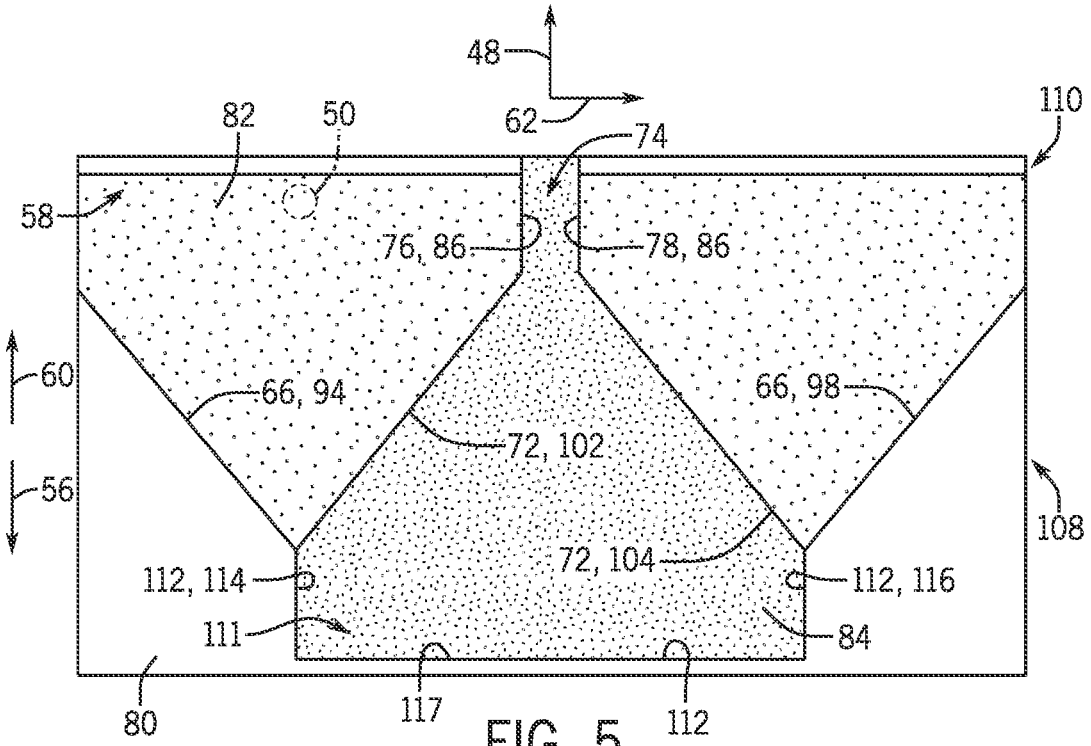
FIG. 5 is a two-dimensional projection of an outer surface of another embodiment of a THRT that may be employed within the tubing hanger orientation assembly of FIG. 2.

FIG. 5 is a two-dimensional projection of an outer surface 108 of another embodiment of a THRT 110 that may be employed within the tubing hanger orientation assembly of FIG. 2, in which the second circumferential surface 82 and the third circumferential surface 84 are represented by different background patterns. In the illustrated embodiment, the second end portion 111 of the THRT 110 is formed by engagement surfaces 112 that form a first side 114 of the second end portion 111, a second side 116 of the second end portion 111, and a third side 117 of the second end portion 111, which extends from the first side 114 to the second side 116 of the second end portion 111. The second end portion 111 extends about approximately half of the circumferential extent of the THRT 110 (e.g., extent of the THRT 110 along the circumferential axis 62). As used herein with regard to the second end portion 111, "approximately half" refers to about 25 percent to about 75 percent, about 30 percent to about 70 percent, about 35 percent to about 65 percent, about 40 percent to about 60 percent, about 45 percent to about 55 percent, or about 50 percent of the circumferential extent of the THRT. In the illustrated embodiment, the engagement surface 112 of the third side 117 of the second end portion 111 is substantially straight (e.g., in the illustrated two-dimensional projection). However, in other embodiments, the engagement surface of the third side of the second end portion may have another suitable shape (e.g., curved, wavy, polygonal, etc.). For example, in certain embodiments, the engagement surface of the third side of the second end portion may include a semi-circular shape (e.g., in which the apex of the semi-circular shape is substantially aligned with the third end portion).

While the engagement surfaces 112 forming the first side 114 and the second side 116 of the second end portion 111 extend substantially along the longitudinal axis 48 in the illustrated embodiment, in other embodiments, the engagement surface(s) forming at least one of the first side or the second side of the second end portion may be angled relative to the longitudinal axis. Furthermore, while the engagement surfaces 112 forming the first side 114 and the second side 116 of the second end portion 111 are substantially straight in the illustrated embodiment, in other embodiments, the engagement surface(s) forming at least one of the first side or the second side of the second end portion may have another suitable shape (e.g., curved, wavy, polygonal, etc.). Furthermore, in certain embodiments, the engagement surface(s) forming at least one of the first side or the second side of the second end portion may be omitted, and respective engagement surface(s) of the first set of engagement surfaces may extend to the engagement surface of the third side of the second end portion.

In the illustrated embodiment, the first engagement surface 94 is configured to guide the engagement feature 50 from the first end portion 58 to the second end portion 111, and the third engagement surface 98 is configured to guide the engagement feature 50 from the first end portion 58 to the second end portion 111. Furthermore, if the engagement feature 50 is positioned within the third end portion 74 after the initial landing of the tubing hanger, the engagement feature 50 may move to the second end portion without being guided by an engagement surface in response to movement of the THRT 110 in the first direction (e.g., upward direction 60). In addition, in the illustrated embodiment, the engagement surfaces 112 forming the second end portion 111 extend radially inward from the first circumferential surface 80 to the third circumferential surface 84. As previously discussed, the engagement surfaces extending between the first and third circumferential surfaces may have a radial extent of about 1 cm to about 10 cm, about 2 cm to about 8 cm, about 2 cm to about 4 cm, or about 2.54 cm. However, in other embodiments, at least one engagement surface 112 of the second end portion 111 may have any other suitable radial extent (e.g., the engagement surface(s) may extend between other suitable surfaces). For example, in certain embodiments, at least two engagement surfaces of the second end portion may have different radial extents. Furthermore, any of the variations with regard to the first, second, and third circumferential surfaces, and the engagement surfaces disclosed above with reference to the THRT of FIGS. 3-4 may apply to the THRT 110 of the illustrated embodiment.

By way of example, during the landing process, the engagement feature 50 may be located at the illustrated position along the circumferential axis 62 after the initial landing of the THRT/tubing hanger. As previously discussed, after the initial landing, the engagement feature 50 may be extended, such that the engagement feature engages the second circumferential surface 82 or the third circumferential surface 84 of the THRT 110. The THRT 110 may then be moved in the upward direction 60. As the THRT 110 moves upwardly, the engagement feature 50 may move toward the first engagement surface 94, contact the first engagement surface 94, and then move along the first engagement surface 94 to the second end portion 111. Contact between the engagement feature 50 and the first engagement surface 94 may drive the THRT 110 to rotate in response to the upward movement of the THRT 110, such that the THRT 110 reaches an intermediate orientation as the engagement feature 50 enters the second end portion 111 (e.g., contacts the engagement surface 112 of the third side 117 of the second end portion 111). The THRT 110 may then be moved in the downward direction 56. As the THRT 110 moves downwardly, the engagement feature 50 may move along the fifth engagement surface 102 to the third end portion 74. Contact between the engagement feature 50 and the fifth engagement surface 102 may drive the THRT 110 to rotate in response to the downward movement of the THRT 110, such that the THRT 110 reaches the target orientation as the engagement feature 50 engages the third end portion 94.

Figure 6:
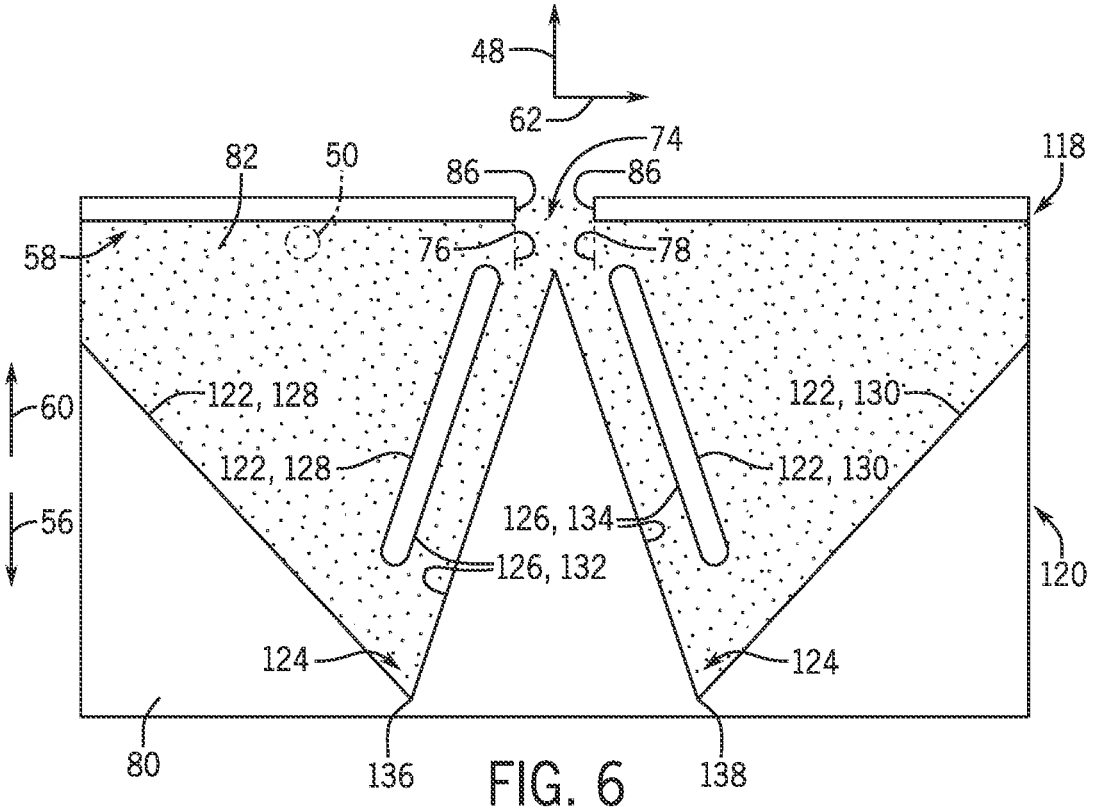
FIG. 6 is a two-dimensional projection of an outer surface of a further embodiment of a THRT that may be employed within the tubing hanger orientation assembly of FIG. 2.

FIG. 6 is a two-dimensional projection of an outer surface 118 of a further embodiment of a THRT 120 that may be employed within the tubing hanger orientation assembly of FIG. 2, in which the second circumferential surface 82 is represented by a background pattern. In the illustrated embodiment, each engagement surface extends from the first circumferential surface 80 to the second circumferential surface 82. For example, the engagement surfaces, which extend between the first and second circumferential surfaces, may have a radial extent of about 0.5 cm to about 5 cm, about 1 cm to about 4 cm, about 1 cm to about 2 cm, or about 1.27 cm. While each engagement surface has the same radial extent in the illustrated embodiment, in other embodiments, at least one engagement surface may have a different radial extent (e.g., due to variation(s) in the radial spacing between the first and second circumferential surfaces). Furthermore, in the illustrated embodiment, the radial extent of each engagement surface is substantially constant. However, in other embodiments, the radial extent of at least one engagement surface may vary along the extent of the engagement surface. Furthermore, the radial extent of each of the first and second circumferential surfaces is substantially constant. However, in other embodiments, the radial extent of at least one of the first circumferential surface or the second circumferential surface may vary (e.g., along the longitudinal axis and/or along the circumferential axis).

In the illustrated embodiment, the THRT 120 includes multiple engagement surfaces configured to guide the engagement feature 50. The engagement surfaces include a first set of engagement surfaces 122 configured to guide the engagement feature 50 from the first end portion 58 to the second end portion 124 of the THRT 120 in response to longitudinal movement of the THRT 120 in the first direction (e.g., upward direction 60). As previously discussed, the first end portion 58 extends about a substantial portion of the circumferential extent of the THRT 120 (e.g., extent of the THRT 120 along the circumferential axis 62), and the circumferential extent of the second end portion 124 (e.g., extent of the second end portion 124 along the circumferential axis 62) is less than the circumferential extent of the first end portion 58 (e.g., extent of the first end portion 58 along the circumferential axis 62). The engagement surfaces also include a second set of engagement surfaces 126 configured to guide the engagement feature 50 from the second end portion 124 of the THRT 120 to the third end portion 74 of the THRT 120 in response to longitudinal movement of the THRT 120 relative to the engagement feature 50 in the second direction (e.g., downward direction 56). As previously discussed, the third end portion 74 extends between the first side 76 of the first end portion 58 and the second side 78 of the first end portion 58 along the circumferential axis 62, and a circumferential extent of the third end portion 74 is substantially equal to a circumferential extent of the engagement feature 50.

In the illustrated embodiment, the first set of engagement surfaces 122 includes a first pair of opposing engagement surfaces 128 and a second pair of opposing engagement surfaces 130. In addition, the second set of engagement surfaces 126 includes a first pair of opposing engagement surfaces 132 and a second pair of opposing engagement surfaces 134. The first pair of opposing engagement surfaces 128 of the first set of engagement surfaces 122 is configured to guide the engagement feature 50 from the first end portion 58 to a first recess 136 of the second end portion 124, and the second pair of opposing engagement surfaces 130 of the first set of engagement surfaces 122 is configured to guide the engagement feature 50 from the first end portion 58 to a second recess 138 of the second end portion 124. Furthermore, if the engagement feature 50 is positioned within the third end portion 74 after the initial landing of the tubing hanger, the first pair of opposing engagement surfaces 132 of the second set of engagement surfaces 126 may guide the engagement feature 50 from the third end portion 74 to the first recess 136 of the second end portion 124, or the second pair of opposing engagement surfaces 134 of the second set of engagement surfaces 126 may guide the engagement feature 50 from the third end portion 74 to the second recess 138 of the second end portion 124. In addition, the first pair of opposing engagement surfaces 132 of the second set of engagement surfaces 126 is configured to guide the engagement feature 50 from the first recess 136 of the second end portion 124 to the third end portion 74, and the second pair of opposing engagement surfaces 134 of the second set of engagement surfaces 126 is configured to guide the engagement feature 50 from the second recess 138 of the second end portion 124 to the third end portion 74. While each recess is substantially V-shaped in the illustrated embodiment, in other embodiments, at least one recess may have another suitable shape.

By way of example, during the landing process, the engagement feature 50 may be located at the illustrated position along the circumferential axis 62 after the initial landing of the THRT/tubing hanger. As previously discussed, after the initial landing, the engagement feature 50 may be extended, such that the engagement feature engages the second circumferential surface 82 of the THRT 120. The THRT 120 may then be moved in the upward direction 60. As the THRT 120 moves upwardly, the engagement feature 50 may move toward an engagement surface of the first pair of opposing engagement surfaces 128 of the first set of engagement surfaces 122, contact the respective engagement surface, and then move along the respective engagement surface to the first recess 136 of the second end portion 124. Contact between the engagement feature 50 and the respective engagement surface may drive the THRT 120 to rotate in response to the upward movement of the THRT 120, such that the THRT 120 reaches an intermediate orientation as the engagement feature 50 engages the first recess 136. The THRT 120 may then be moved in the downward direction 56. As the THRT 120 moves downwardly, the engagement feature 50 may move along the first pair of opposing engagement surfaces 132 of the second set of engagement surfaces 126 to the third end portion 74. Contact between the engagement feature 50 and the first pair of opposing engagement surfaces 132 of the second set of engagement surfaces 126 may drive the THRT 120 to rotate in response to the downward movement of the THRT 120, such that the THRT 120 reaches the target orientation as the engagement feature 50 engages the third end portion 74.

While embodiments in which the engagement feature is coupled to the orientation spool and the engagement surfaces are formed on the outer surface of the THRT (e.g., annular structure) are disclosed above, in certain embodiments, the engagement feature may be coupled to the THRT and the engagement surfaces may be formed on the inner surface of the orientation spool (e.g., annular structure). In such embodiments, the engagement surface configuration may be inverted such that the second end portion is positioned above the first and third end portions (e.g., the two dimensional projection may be inverted). In addition, during the initial landing of the tubing hanger, the engagement feature may be positioned within the first end portion or the third end portion at the bottom of the orientation spool. Furthermore, in certain embodiments, the engagement feature may be coupled to another suitable component (e.g., of the wellhead system), and the engagement surfaces may be formed on a corresponding component/annular structure (e.g., of the wellhead system). For example, in certain embodiments, the engagement feature may be coupled to the orientation spool, a production tree, the BOP, a casing spool, a tubing spool, or another suitable component (e.g., of the wellhead system), and the engagement surfaces may be formed on the outer surface of the THRT, the tubing hanger, or another suitable component/annular structure (e.g., of the wellhead system). Furthermore, in certain embodiments, the engagement feature may be coupled to the THRT, the tubing hanger, or another suitable component (e.g., of the wellhead system), and the engagements surfaces may be formed on the inner surface of the orientation spool, a production tree, the BOP, a casing spool, a tubing spool, or another suitable component/annular structure (e.g., of the wellhead system).

Technical effects of the disclosure include enabling the tubing hanger to be initially landed in any orientation and driving the tubing hanger to the target orientation via upward and downward movement of the tubing hanger. For example, because the first and third end portions collectively extend about the entire circumferential extent of the THRT, the THRT/tubing hanger may be initially landed in any orientation, and the tubing hanger orientation assembly may drive the THRT/tubing hanger to rotate from the initially landed orientation to the target orientation. In addition, because the first set of engagement surfaces is configured to drive the THRT/tubing hanger to rotate to an intermediate orientation in response to the upward movement, and the second set of engagement surfaces is configured to drive the THRT/tubing hanger to rotate to the target orientation in response to the downward movement, the length of the THRT and the corresponding length of the orientation spool may be reduced (e.g., as compared to a THRT having a single set of engagement surfaces/single engagement surface configured to drive the THRT/tubing hanger to rotate from an initial orientation to the target orientation via movement of the THRT/tubing hanger in a single direction). As a result, the bending load applied to component(s) of the wellhead system may be reduced, and/or the cost of the wellhead system may be reduced.

While only certain features have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A tubing hanger orientation assembly, comprising:

an annular structure having a plurality of engagement surfaces, wherein the plurality of engagement surfaces comprises:

a first set of engagement surfaces configured to guide an engagement protrusion from a first end portion of the annular structure to a second end portion of the annular structure in response to longitudinal movement of the annular structure relative to the engagement protrusion in a first direction, wherein the first end portion extends about a substantial portion of a circumferential extent of the annular structure, and a circumferential extent of the second end portion is less than a circumferential extent of the first end portion; and a second set of engagement surfaces configured to guide the engagement protrusion from the second end portion of the annular structure to a third end portion of the annular structure in response to longitudinal movement of the annular structure relative to the engagement protrusion in a second direction, opposite the first direction, wherein the third end portion extends between a first side of the first end portion and a second side of the first end portion along a circumferential axis of the annular structure, and a circumferential extent of the third end portion is substantially equal to a circumferential extent of the engagement protrusion;

wherein each engagement surface of the plurality of engagement surfaces is configured to drive the annular structure to rotate relative to the engagement protrusion in response to contact with the engagement protrusion and longitudinal movement of the annular structure relative to the engagement protrusion;

wherein the second end portion comprises a plurality of recesses, and each engagement surface of the first set of engagement surfaces is configured to guide the engagement protrusion to a respective recess of the plurality of recesses in response to longitudinal movement of the annular structure relative to the engagement protrusion in the first direction.

2. The tubing hanger orientation assembly of claim 1, wherein the annular structure comprises a tubing hanger running tool (THRT), and the plurality of engagement surfaces is formed on an outer surface of the THRT.

3. The tubing hanger orientation assembly of claim 1, wherein each engagement surface of the first set of engagement surfaces extends radially inward from a first circumferential surface to a second circumferential surface, and each engagement surface of the second set of engagement surfaces extends radially inward from the second circumferential surface to a third circumferential surface.

4. The tubing hanger orientation assembly of claim 3, wherein engagement surfaces forming the third end portion extend radially inward from the second circumferential surface to the third circumferential surface.

5. The tubing hanger orientation assembly of claim 3, wherein an engagement surface forming the second end portion extends radially inward from the first circumferential surface to the third circumferential surface.

6. The tubing hanger orientation assembly of claim 1, wherein the second end portion extends about approximately half of the circumferential extent of the annular structure.

7. The tubing hanger orientation assembly of claim 1, wherein the first set of engagement surfaces comprises two pairs of opposing engagement surfaces, and the second set of engagement surfaces comprises two pairs of opposing engagement surfaces.

8. A tubing hanger orientation assembly, comprising:

an engagement protrusion extending radially inward from an orientation spool, wherein the engagement protrusion is movable along a radial axis of the tubing hanger orientation assembly;

a tubing hanger running tool (THRT) having a plurality of engagement surfaces formed on an outer surface of the THRT, wherein the plurality of engagement surfaces comprises:

a first set of engagement surfaces configured to guide the engagement protrusion from a first end portion of the THRT to a second end portion of the THRT in response to longitudinal movement of the THRT relative to the engagement protrusion in a first direction, wherein the first end portion extends about a substantial portion of a circumferential extent of the THRT, and a circumferential extent of the second end portion is less than a circumferential extent of the first end portion; and a second set of engagement surfaces configured to guide the engagement protrusion from the second end portion of the THRT to a third end portion of the THRT in response to longitudinal movement of the THRT relative to the engagement protrusion in a second direction, opposite the first direction, wherein the third end portion extends between a first side of the first end portion and a second side of the first end portion along a circumferential axis of the THRT, and a circumferential extent of the third end portion is substantially equal to a circumferential extent of the engagement protrusion;

wherein each engagement surface of the plurality of engagement surfaces is configured to drive the THRT to rotate relative to the engagement protrusion in response to contact with the engagement protrusion and longitudinal movement of the THRT relative to the engagement protrusion;

wherein the first set of engagement surfaces comprises two pairs of opposing engagement surfaces, and the second set of engagement surfaces comprises two pairs of opposing engagement surfaces.

9. The tubing hanger orientation assembly of claim 8, wherein each engagement surface of the first set of engagement surfaces extends radially inward from a first circumferential surface to a second circumferential surface, and each engagement surface of the second set of engagement surfaces extends radially inward from the second circumferential surface to a third circumferential surface.

10. The tubing hanger orientation assembly of claim 9, wherein engagement surfaces forming the third end portion extend radially inward from the second circumferential surface to the third circumferential surface.

11. The tubing hanger orientation assembly of claim 9, wherein an engagement surface forming the second end portion extends radially inward from the first circumferential surface to the third circumferential surface.

12. The tubing hanger orientation assembly of claim 8, wherein the second end portion extends about approximately half of the circumferential extent of the THRT.

13. The tubing hanger orientation assembly of claim 8, wherein the second end portion comprises a plurality of recesses, and each engagement surface of the first set of engagement surfaces is configured to guide the engagement protrusion to a respective recess of the plurality of recesses in response to longitudinal movement of the THRT relative to the engagement protrusion in the first direction.

14. A tubing hanger orientation assembly, comprising:

a tubing hanger running tool (THRT) having a plurality of engagement surfaces formed on an outer surface of the THRT, wherein the plurality of engagement surfaces comprises:

a first engagement surface configured to guide an engagement protrusion from a first end portion of the THRT to a first recess of a second end portion of the THRT in response to longitudinal movement of the THRT relative to the engagement protrusion in a first direction, wherein the first end portion extends about a substantial portion of a circumferential extent of the THRT;

a second engagement surface configured to guide the engagement protrusion from the first end portion of the THRT to the first recess in response to longitudinal movement of the THRT relative to the engagement protrusion in first direction, wherein the first and second engagement surfaces converge toward the first recess;

a third engagement surface configured to guide the engagement protrusion from the first end portion of the THRT to a second recess of the second end portion of the THRT in response to longitudinal movement of the THRT relative to the engagement protrusion in the first direction;

a fourth engagement surface configured to guide the engagement protrusion from the first end portion of the THRT to the second recess in response to longitudinal movement of the THRT relative to the engagement protrusion in the first direction, wherein the third and fourth engagement surfaces converge toward the second recess;

a fifth engagement surface configured to guide the engagement protrusion from the first recess to a third end portion in response to longitudinal movement of the THRT relative to the engagement protrusion in a second direction, opposite the first direction, wherein the third end portion extends between a first side of the first end portion and a second side of the first end portion along a circumferential axis of the THRT, and a circumferential extent of the third end portion is substantially equal to a circumferential extent of the engagement protrusion; and a sixth engagement surface configured to guide the engagement protrusion from the second recess to the third end portion in response to longitudinal movement of the THRT relative to the engagement protrusion in the second direction, wherein the fifth and sixth engagement protrusion converge toward the third end portion;

wherein each engagement surface of the plurality of engagement surfaces is configured to drive the THRT to rotate relative to the engagement protrusion in response to contact with the engagement protrusion and longitudinal movement of the THRT relative to the engagement protrusion.

15. The tubing hanger orientation assembly of claim 14, wherein the first engagement surface and the third engagement surface have a first radial extent, the second engagement surface and the fourth engagement have a second radial extent, and the second radial extent is greater than the first radial extent.

16. The tubing hanger orientation assembly of claim 15, wherein a third radial extent of engagement surfaces forming the first and second recesses is substantially equal to the second radial extent of the second and fourth engagement surfaces.

17. The tubing hanger orientation assembly of claim 15, wherein the fifth engagement surface and the sixth engagement surface have a fourth radial extent, and the fourth radial extent is substantially equal to the second radial extent minus the first radial extent.

18. The tubing hanger orientation assembly of claim 15, wherein a fifth radial extent of engagement surfaces forming the third end portion is substantially equal to the second radial extent minus the first radial extent.

* * * * *